United States Patent [19]

Laisure

[11] Patent Number: 4,883,277

[45] Date of Patent: Nov. 28, 1989

[54] EDUCATIONAL BOARD GAME FOR TEACHING MATHEMATICS AND LOGIC

[76] Inventor: Thomas J. Laisure, 9113 W. 69th Ter., Merriam, Kans. 66204

[21] Appl. No.: 252,610

[22] Filed: Sep. 30, 1988

[51] Int. Cl.[4] ..... A63F 3/06; G09B 19/22; G09B 19/02

[52] U.S. Cl. ..... 273/236; 273/265; 434/129; 434/188

[58] Field of Search ..... 273/236, 273, 268, 265, 273/274, 272; 434/129, 188

[56] References Cited

U.S. PATENT DOCUMENTS

| | | | |
|---|---|---|---|
| 4,236,719 | 12/1980 | Kerr | 273/265 |
| 4,502,689 | 3/1985 | Al-Harari | 273/265 |
| 4,684,135 | 8/1987 | Bouchal | 273/236 |

*Primary Examiner*—Edward M. Coven
*Assistant Examiner*—Valerie Szczepanik
*Attorney, Agent, or Firm*—Hovey, Williams, Timmons & Collins

[57] ABSTRACT

An educational game includes a substrate having a plurality of separate sets of indicia thereon and structure for exhibiting the indicia of one of the sets of the substrate. A random symbol is generated from a plurality of possible symbols and an initial exhibition of a number fewer than all of the indicia in the set is carried out such that the number of indicia exhibited corresponds in value to the generated symbol. During the initial exhibition, the remaining indicia of the set which are not revealed are concealed by the structure. A player playing the game is provided with a way to indicate his or her prediction of a designated indicia to be subsequently revealed in the set so that upon subsequent exhibition of the indicia of the set, a comparison with the player's choice may be made. A method of playing the game includes the steps of partially removing the card from a container by an amount and in a manner sufficient to reveal a number fewer than all of a plurality of indicia on the card, and positioning a marker on an indicium within a field on a game board to indicate a prediction as to a designated indicia to be subsequently revealed on the card.

2 Claims, 2 Drawing Sheets

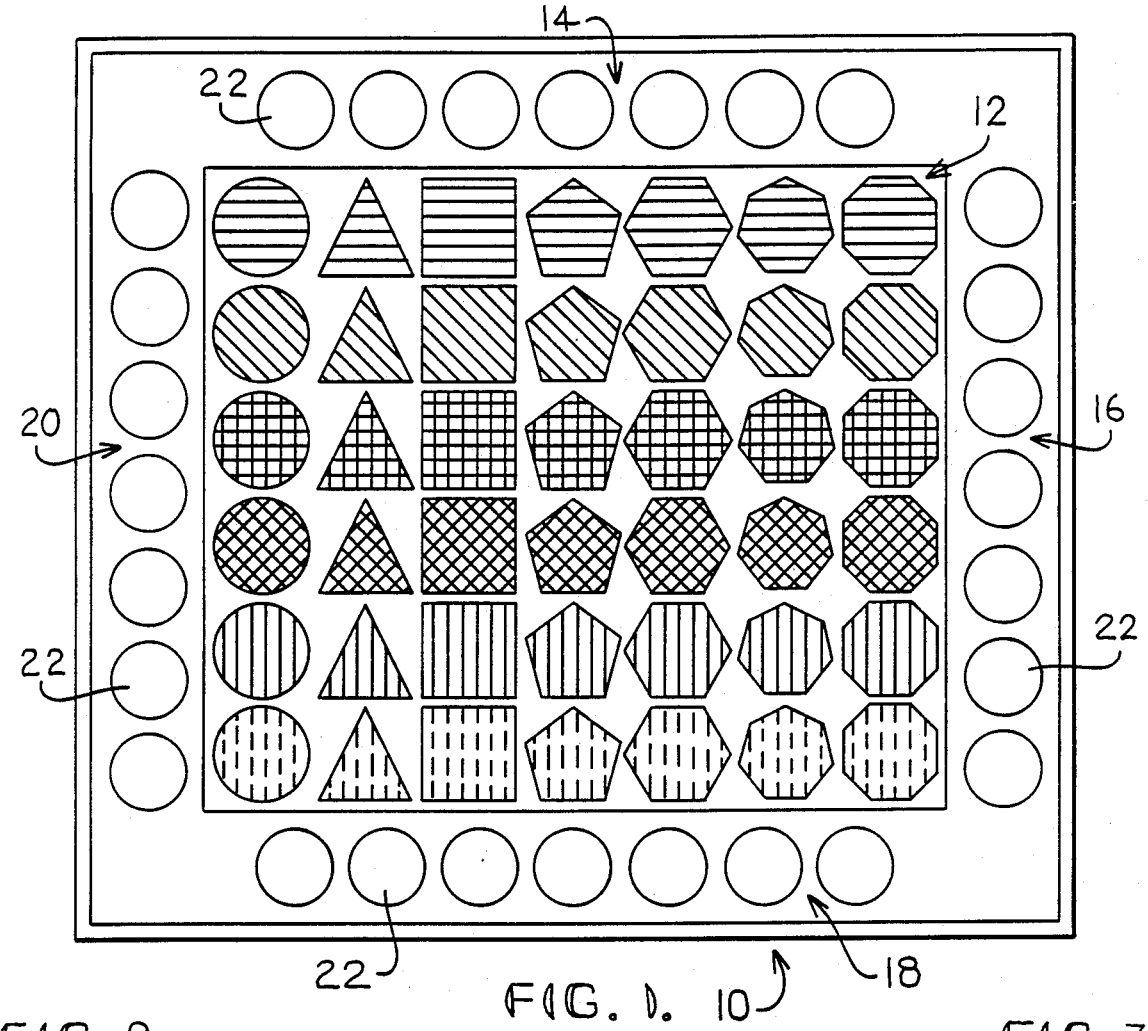
FIG. 1.
FIG. 2.
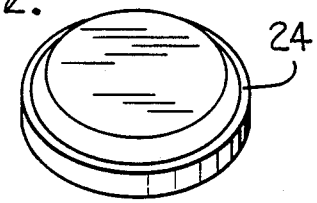
FIG. 3.
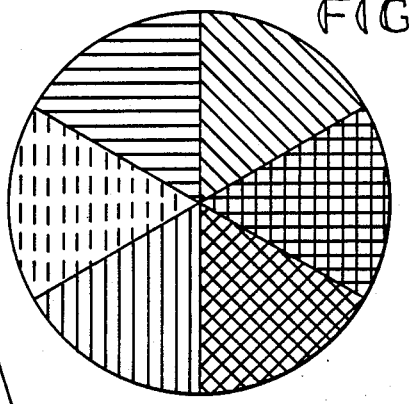
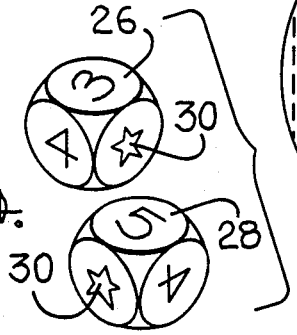
FIG. 4.
FIG. 5.
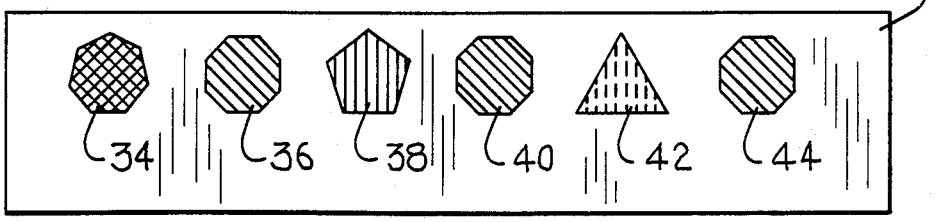

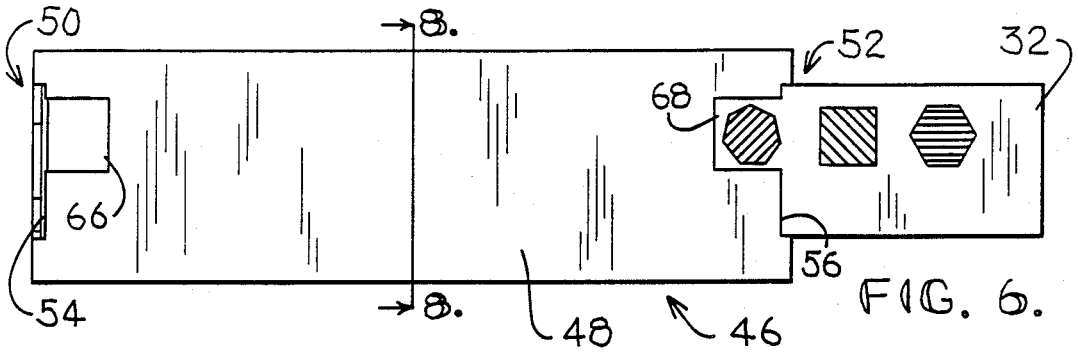
FIG. 6.
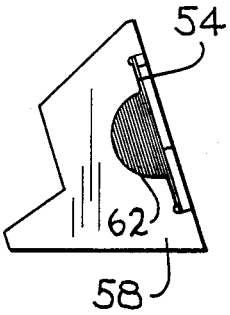
FIG. 7.
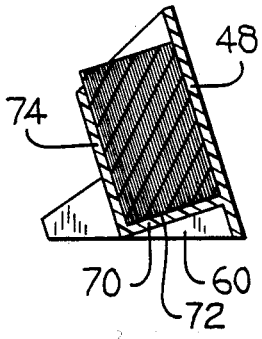
FIG. 8.
FIG. 9.
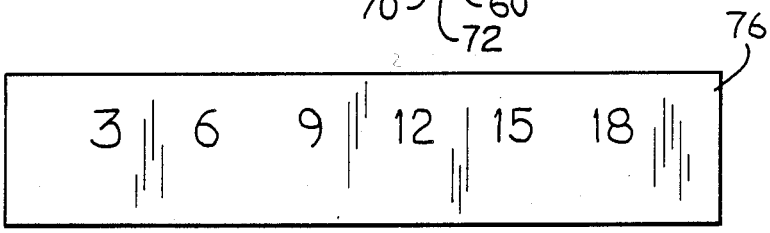
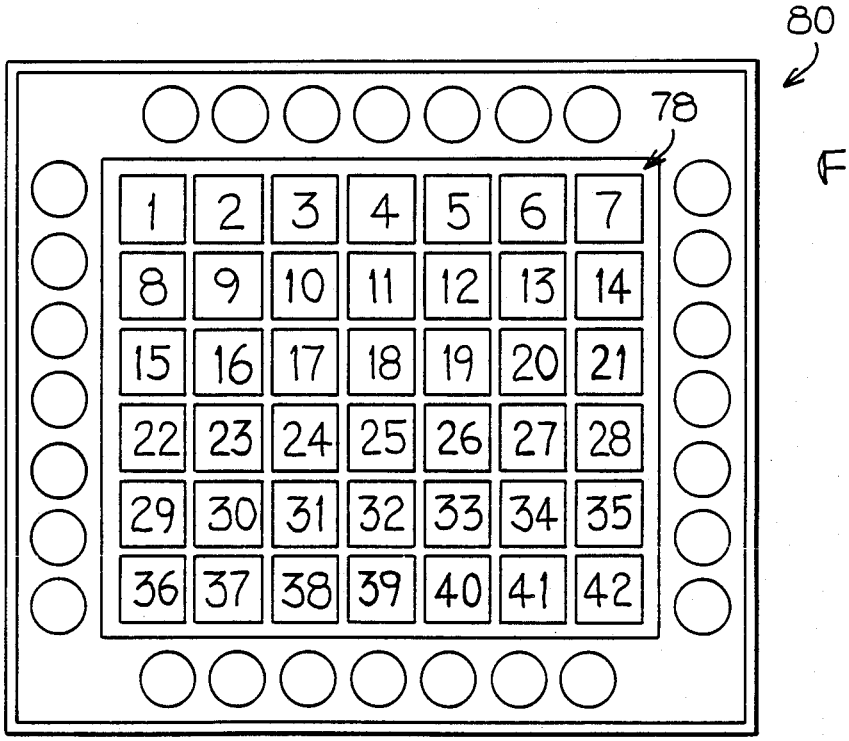
FIG. 10.

EDUCATIONAL BOARD GAME FOR TEACHING MATHEMATICS AND LOGIC

BACKGROUND OF THE INVENTION

1. Field of the Invention

The present invention relates generally to games and, more particularly, to an educational board game and method of playing the game, in which players attempt to predict which one of a range of indicia will be revealed in a set of indicia after having seen a number fewer than all of the indicia in the set.

2. Discussion of the Prior Art

A known method for educating school children in mathematics and logic includes the steps of providing a set of numbers which follow a predetermined series or progression, and requesting that the student determine what a subsequent number following the series or progression might be. Methods such as this have also been employed previously in examinations which test the exam taker's mathematical and/or logic skills. However, because the method is designed only to educate or test a student's skills, it is possible that the student will quickly lose interest in the educational method or will not devote his or her full efforts in solving the problems presented thereby. For these reasons, as well as others, it is desirable that a teaching method or educational device be provided which not only primes a student's skills, but which entertains the student and holds his or her complete interest for a period of time exceeding that which the student might devote to pure study.

OBJECTS AND SUMMARY OF THE INVENTION

It is an object of the present invention to provide an educational game of logic and reasoning which tests the relative deduction skills between players participating in the game and which simultaneously affords entertainment for the players.

It is another object of the present invention to provide a game in which sets of indicia of different shapes, sizes, colors, etc., are arranged in deducible series or progressions which are attractive to look at and fun to solve.

According to the invention, an educational game includes a substrate having a plurality of separate sets of indicia thereon and structure for exhibiting the indicia of one of the sets on the substrate. Chance means are provided for generating a random symbol from a plurality of possible symbols and means for exhibiting the indicia of one of the sets on the substrate includes structure permitting an initial exhibition of a number fewer than all of the indicia in the set. The number of indicia exhibited during the initial exhibition corresponds in value to the generated symbol, and the remaining indicia of the set which are not revealed are concealed by the structure. A player playing the game is provided with means for indicating his or her choice of a predicted indicia to be subsequently revealed in the set so that upon a subsequent exhibition of the indicia of the set, a comparison with the player's choice may be made.

It is preferred that the game include a plurality of cards each having at least one set of indicia thereon which is different from every other one of the sets of indicia, and a container in which the plurality of cards are stacked. The container preferably includes a front wall and a first slot through which the card resting adjacent the front wall is removable from the container to reveal a number fewer than all of the plurality of indicia on the card in correspondence with the generated symbol. A second slot may also be provided opposite the first slot so that the card adjacent the front wall may be optionally removed through either of the slots to reveal different ones of the plurality of indicia on the card. In order for the cards to be contained in the container, yet be easily removable therefrom, side walls are provided along with a bottom wall, and the slots are formed in the side walls and extend upwardly from the bottom wall.

The preferred game board employed with the game includes a playing surface provided with a first region including a field of individual and unique indicia thereon provided in groups, each of which includes substantially identically shaped indicia which are dissimilarly colored from one another. However, other indicia such as numbers or pictures could be employed on the board as well, so long as the field of indicia provided on the board displays the entire range of possible indicia presented on the cards. In this manner, a player can position a marker on one of the indicia within the field on the game board after the initial exhibition to indicate that player's choice of a predicted indicia to be subsequently revealed on the card. In addition, on the game board, the same plurality of colors are preferably employed in each group, with the indicia of each group being arranged end-to-end in a first direction on the playing surface and with all indicia of the same color in the field being arranged end-to-end in a second direction perpendicular to the first direction. A plurality of additional regions may also be provided on the board for permitting a score to be kept as to the number of correct predictions made by each of the players. These additional regions may include a group of similarly shaped and colored indicia which set the regions apart from the first region.

The inventive method includes the steps of providing a game board having a field of individual indicia thereon, generating a random symbol, and partially removing a card from a container by an amount and in a manner sufficient to reveal a number fewer than all of a plurality of indicia on the card. Each of the indicia of the plurality is identical to one of the indicia in the field and the number of indicia revealed corresponds to the output symbol. Additional steps of the inventive method include positioning a marker on one of the indicia within the field on the game board to indicate the player's choice of a predicted indicia to be subsequently revealed on the card, and further removing the partially removed card from the container to reveal further indicia on the card for comparison with the player's choice. A supplementary step preferably includes removing the marker from the one indicium within the field on which it was positioned and placing a marker in a scoring region of the game board if the one indicium on which the marker was positioned corresponds with a designated indicium on the card removed from the container.

The game resulting from the inventive construction provides an entertaining yet challenging test of each player's reasoning skills and disguises logic training in a game which is fun to play and which is capable of holding a player's interest for a period of time exceeding that of normal study.

BRIEF DESCRIPTION OF THE DRAWING FIGURES

A detailed embodiment of the present invention is discussed below with reference to the attached drawing figures, in which:

FIG. 1 is a plan view of a preferred game board for use in the present invention;

FIG. 2 is a perspective view of a marker made in accordance with the preferred embodiment of the present invention;

FIG. 3 is a plan view of a color table for use with the inventive game;

FIG. 4 is a perspective view of a pair of dice for use with the inventive game;

FIG. 5 is a plan view of a playing card constructed in accordance with the invention;

FIG. 6 is a front view of a card container used with the invention;

FIG. 7 is a side view of the card container of FIG. 6;

FIG. 8 is a side sectional view of the container;

FIG. 9 is a plan view of a playing card constructed in accordance with an alternative embodiment of the invention; and FIG. 10 is a plan view of a game board for use with the playing card of FIG. 9 in carrying out the alternative embodiment of the invention.

DETAILED DESCRIPTION OF A PREFERRED EMBODIMENT

A game board 10 for use with the present invention is illustrated in FIG. 1, and includes a first region 12 having a field of individual and unqiue indicia thereon provided in seven groups of six substantially identically shaped indicia. The groups of indicia are arranged across the board 10 in a logical sequence beginning with the group of circles disposed at one side of the board and ending with the group of octagons arranged at the opposite side of the board. The sequence followed by the arrangement is that the circles each have one side; the triangles each have three sides; the square, four; the pentagons, five; the hexagons, six; the heptagons, seven; and the octagons, eight.

In addition to the groups of indicia being arranged in this sequence across the board, the indicia within each group are arranged in an end-to-end fashion and are colored differently from one another so that each of the similarly shaped indicia within each group is unique. The manner in which the colors are assigned to the indicia within each group also follows a logical sequence so as to present the indicia on the board in a pattern illustrating the proper order or progression of colors employed in the game. For example, in the preferred embodiment, the three primary colors and three secondary colors are employed. The logical sequence employed in the color scheme of the preferred game is a repetitive one following the sequence; red, orange, yellow, green, blue and purple. These colors are displayed on a color wheel provided with the game, such as that illustrated in FIG. 3, to enable a player to see the relationship between the colors and to recognize color sequences during the game.

A number of second regions 14, 16, 18 and 20 are disposed around the periphery of the first region 12, and each of the second regions 14, 16, 18 and 20 includes a plurality of seven indicia 22 arranged in an end-to-end fashion. These second regions of indicia permit a score to be kept of the progress of each of the players, and are employed in a manner described more fully below.

A number of markers, such as the marker 24 shown in FIG. 2, are included with the game and are sized proportionally to the indicia in the first and second regions 12, 14, 16, 18 and 20 on the board. These markers 24 may be stacked on top of one another if desired and are used for the dual purpose of indicating a player's choice of an indicium in the first region 12 during play of the game, and of indicating a player's score in the second regions 14, 16, 18 and 20. The specific manner in which these markers 24 are employed in the game is discussed below with reference to the method of playing the game.

A pair of dice 26, 28 are shown in FIG. 4 to include a plurality of numbers and symbols on the faces thereof, and are used during play of the game to generate a random symbol. In the preferred embodiment, only one die 26 is used and the numbers on the die range from three to five, there being, e.g. a three, two fours, a five and two stars 30 provided on the faces thereof. The procedure for using the die 26 and the relevance of the stars 30 thereon is described below.

In accordance with the preferred embodiment of the present invention, a plurality of cards, such as the card 32 shown in FIG. 5, are each provided with a set of six indicia extending in an end-to-end fashion across the card. Every indicia on each card has a corresponding, substantially identical indicia in the first region 12 of the board 10, and the indicia on the card 32 are arranged in a logical sequence of either color, shape, or a combination thereof. For example, on the card 32 shown, the first indicia 34 is an orange heptagon having seven sides, the third indicia 38 is a red pentagon having five sides, the fifth indicia 42 is a purple triangle having three sides, and the interposed second, fourth and sixth indicia 36, 40, 44 are all green octagons. Thus, the first, third and fifth indicia 34, 38, 42 extending from the left end of the card 32 follow a pattern wherein the number of sides on each indicia changes constantly from one to another, and every other indicia on the card is a green octagon.

A container 46 for holding the plurality of cards is illustrated in FIGS. 6–8. As shown in FIG. 6, the container 46 includes a front wall 48 having openings 50, 52 at the ends thereof for gripping and removing a card from the container. From FIG. 7, it can be seen that each opening includes a slot 54, 56 provided in a side wall 58, 60 of the container 46, as well as a gripping opening 62, 64 and a display window 66, 68. The dimension of each slot 54, 56 in the direction extending rearwardly of the front wall 48 is substantially the same as the thickness of each of the cards 32 so that only one of the cards, the one resting adjacent the front wall 48, may be removed from the container 46 at any one time. The gripping opening 62, 64 enables a player to easily grip the forwardmost card 32 to remove it from its concealed position behind the front wall 48, and the display window 66, 68 is positioned on the front wall 48 to exhibit the indicia on the card 32 as the card is pulled from the container 46.

A bottom wall 70, as seen in FIG. 8, extends rearwardly of the front wall 48 and provides support for the cards in the container 46. In addition, the upper surface 72 of the bottom wall 70 meets the slots 54, 56 in the side walls 58, 60 and serves the purpose of positioning the cards with respect to the slots 54, 56. A rear wall 74 is also included on the container 46 and restricts the space therein so that as cards are removed from and replaced to the container 46, the forwardmost card is urged to a position adjacent the front wall 48. Although not shown in in the preferred embodiment, a resiliently biased rear wall could be employed to ensure proper alignment of the forwardmost card with the slots.

An alternative embodiment of the game is illustrated in FIGS. 9 and 10, and comprises the same structural components as the embodiment discussed above. However, in this alternative embodiment, the indicia on the cards and in the first region of the board are numerals rather than colored shapes. For example, each card 76 includes a series or progressions of numbers, each of which is represented in the field of numerals displayed in the first region 78 of the board shown in FIG. 10. This second embodiment is discussed to illustrate that any plurality of indicia that can be arranged in logical sequences may be employed with the game of the present invention. Such a construction permits the game to be designed for use by players of any given age group or educational level.

The preferred method of playing the game is as follows. Each player is provided with a plurality of markers such as the marker 24 shown in FIG. 2, and is assigned one of the second regions 14, 16, 18 and 20 of the game board for use in keeping his or her score. One of the players is selected to go first and he or she rolls the die 26 to generate a random symbol. For the purpose of describing the game, an exemplary roll of three will be presumed. Thereafter, the selected player grips the forwardmost card 32 in the container 46 and removes it through either of the slots 54, 56 until three of the indicia on the card are revealed to the players. Likewise, if a four were rolled on the die, the card 32 would be withdrawn from the container until four indicia were displayed and if a five were rolled, the card would be removed until five indicia were visible.

Once the three indicia are exhibited, the selected player places a marker 24 on the board 10 over one of the indicia in the field of the first region 12. The indicia chosen by the selected player represents that player's prediction as to what the last indicia concealed on the card 32 will be. For example, if the card has been removed to exhibit three indicia on the card as illustrated in FIG. 6, the marker 24 would be placed on the board 10 over an indicia corresponding to the indicia the selected player believes will be the leftmost indicia on the card 32.

Immediately after the selected player has placed his marker 24 on the indicia of his or her choice, the remaining players place one of their markers 10 on the board over one of the uncovered indicia in the first region 12. No sequence is followed in determining the order of selection of the indicia by the remaining players and all of them may move at once to cover the indicia of their choice, thus rewarding the player who is quickest in predicting which indicia he or she believes will appear in the designated position on the card 32. However, once one player's marker is positioned over one of the indicia in the field, none of the remaining players can place a marker over that indicia. Therefore, it is only possible for one player to have the correct prediction with respect to the last indicium to be exposed on each card played.

Once all of the players have placed a marker 24 on one of the indicia in the field, thus registering their prediction as to what the last indicium on the card 32 will be, the card is removed completely from the container 46 to reveal all of the remaining indicia, and the player whose marker is covering the corresponding indicium of the field places a marker 24 on one of the indicia 22 in his or her assigned second region 14, 16, 18, 20 of the board 10 to register that a correct prediction has been made. The remaining players do not place any markers in their assigned second regions, and all of the markers in the first region 12 of the board are removed therefrom prior to a subsequent repetition of the above-described steps. Thereafter, the selected card is replaced in the rear of the container, another player is selected and the game continues until one of the players has made a designated number of correct predictions. In the embodiment illustrated in FIG. 1, seven correct predictions by any one player wins the game.

If, instead of a numeral, a selected player rolls a star 30, a variation of the above-described method is followed. Initially, the selected player removes the forwardmost card 32 from the container 46 to reveal one indicium on the card. After this first indicium is exhibited, each of the players may at once place a marker 24 on the board 10 over one of the indicia of the field which he or she predicts will be the last indicia revealed on the card. Once all of the players have made a choice, the selected player partially removes the card 32 until the first and second indicia thereon are exhibited, and again, all of the players are free to place another marker 24 on the board over the indicia they now believe will be the last indicia of the sequence. If it is predicted by any of the players that the same indicia will appear as was previously predicted by that player when one indicia was showing on the card, that player may place the second marker on top of the first marker. At no time may one of the players place a marker on an indicium which has already been selected by one of the remaining players during play with respect to each card 32.

After all of the players have made their second predictions, the same procedure is followed in revealing the third, fourth and fifth indica. Thereafter, the card 32 is removed from the container 46 to reveal the remaining indicium thereon and the player who has at least one marker 24 covering the corresponding indicia in the field records the correct prediction. If two or more markers are covering the indicia on the board 10 which corresponds to the designated indicia on the card 32, a similar number of markers are placed in that player's scoring region 14, 16, 18 or 20 on the board 10.

The method followed in playing the second embodiment of the game as illustrated in FIGS. 9 and 10 is identical to that described above and is not discussed in further detail. However, by illustrating the second embodiment, it can be seen that the inventive game can be designed to test the players with different types of indicia so as to develop reasoning skills applicable to all areas in which logical progressions are found.

Although the present invention has been described with reference to the illustrated preferred embodiments, it is understood that substitutions may be made and equivalents employed herein without departing from the invention as defined by the following claims.

What is claimed is:

1. A method of playing an educational board game comprising the steps of:

providing a game board having a field of individual indicia thereon;

generating a random symbol; partially removing a card from a container by an amount and in a manner sufficient to reveal a number fewer than all of a plurality of indicia on the card, each of the indicia of the plurality being identical to one of the indicia in the field, the number of indicia revealed corresponding to the random symbol;

positioning a marker on one of the indicia within the field on the game board to indicate a player's predicition of a designated indicia to be subsequently revealed on the card; and further removing the partially removed card from the container to reveal further indicia on the card for comparison with the player's choice.

2. The method acording to claim 1, further comprising the step of removing the marker from the one indicium within the field on which it was positioned and placing a marker in a scoring region of the game board if the one indicium on which the marker was positioned corresponds with the designated indicium on the card removed from the container.

* * * * *